US011319705B2

(12) United States Patent
Van De Voorde et al.

(10) Patent No.: US 11,319,705 B2
(45) Date of Patent: May 3, 2022

(54) CONSTRUCTION UNIT FOR A FRAME

(71) Applicant: JUUNOO NV, Zwevegem (BE)

(72) Inventors: Chris Van De Voorde, Kortrijk (BE); Lucas Rik Ferdinand Wyffels, Poperinge (BE)

(73) Assignee: JUUNOO NV

( * ) Notice: Subject to any disclaimer, the term of this patent is extended or adjusted under 35 U.S.C. 154(b) by 0 days.

(21) Appl. No.: 17/059,504

(22) PCT Filed: Sep. 23, 2019

(86) PCT No.: PCT/IB2019/058014
§ 371 (c)(1),
(2) Date: Nov. 30, 2020

(87) PCT Pub. No.: WO2020/065487
PCT Pub. Date: Apr. 2, 2020

(65) Prior Publication Data

US 2021/0207371 A1 Jul. 8, 2021

(30) Foreign Application Priority Data

Sep. 24, 2018 (BE) ..... 2018/5653

(51) Int. Cl.
*E04B 2/74* (2006.01)
*E04B 2/76* (2006.01)
*E04C 3/00* (2006.01)

(52) U.S. Cl.
CPC ..... *E04B 2/7459* (2013.01); *E04B 2/767* (2013.01); *E04C 3/005* (2013.01)

(58) Field of Classification Search
CPC ..... E04B 2/7459; E04B 2/767; E04C 3/005
See application file for complete search history.

(56) References Cited

U.S. PATENT DOCUMENTS 2,005,145 A * 6/1935 Kotrbaty ..... E04B 2/7854 52/580
3,078,968 A * 2/1963 Frick ..... E04B 2/7818 52/241

(Continued)

FOREIGN PATENT DOCUMENTS

FR 2411282 A1 7/1979

OTHER PUBLICATIONS

Search Report for International Patent Application PCT/IB2019/058014, dated Apr. 2, 2020.

*Primary Examiner* — James M Ference
(74) *Attorney, Agent, or Firm* — Fresh IP PLC; Clifford D. Hyra; Aubrey Y. Chen

(57) ABSTRACT

Construction unit (1) for building up a frame (2), wherein the frame (2) comprises at least two girders (3*a*, 3*b*) and multiple uprights (4), wherein the construction unit (1) comprises a first construction profile (4), a second construction profile (5) and a third construction profile (6), wherein the first construction profile (4) is provided to serve as an upright (4) and the second and the third construction profile (5, 6) are each provided to be part of a respective girder (3*a*, 3*b*), wherein each construction unit (1) is provided to form only one upright (4) of a frame (2) and that multiple such construction units (1) are provided to be successively interconnected so that the first construction profiles (4) of successively construction units (1) extend at a distance from one another.

14 Claims, 11 Drawing Sheets

(56) References Cited

U.S. PATENT DOCUMENTS 3,680,271 A * 8/1972 Satchell ..... E04B 2/58 52/656.1
3,845,601 A * 11/1974 Kostecky ..... E04B 1/2403 52/290
3,952,462 A * 4/1976 Heise ..... E04B 2/58 52/62
4,546,591 A * 10/1985 Beltz ..... E04C 3/08 52/645
4,612,848 A * 9/1986 Pollack ..... E21F 1/14 182/159
4,708,189 A * 11/1987 Ward ..... E04G 21/243 160/351
5,425,212 A * 6/1995 Menchetti ..... E04C 3/005 16/226
5,735,100 A * 4/1998 Campbell ..... E04B 1/3447 52/645
5,950,392 A * 9/1999 Short, V ..... E04C 3/42 52/690
6,050,045 A * 4/2000 Campbell ..... E04B 1/3441 52/126.6
8,028,487 B2 * 10/2011 Engstrom ..... E04B 2/767 52/645
8,943,764 B1 * 2/2015 Averitt ..... E04B 1/34342 52/169.12
10,006,205 B2 * 6/2018 Diamond ..... E04D 3/3608
2002/0116893 A1 * 8/2002 Waldrop ..... E04C 3/005 52/843
2007/0011971 A1 * 1/2007 Sitkiewicz ..... E04B 2/767 52/481.1
2007/0193187 A1 * 8/2007 O'Connor ..... E04B 2/825 52/653.1
2008/0053035 A1 * 3/2008 Rosenberg ..... E04B 2/7457 52/483.1
2008/0168733 A1 * 7/2008 Tollenaar ..... E04B 2/767 52/481.1
2009/0183840 A1 * 7/2009 Muehlebach ..... E04G 21/30 160/87
2010/0058689 A1 * 3/2010 Campbell ..... E04B 1/3205 52/270
2013/0000242 A1 * 1/2013 Ferguson ..... E04B 2/767 52/653.1
2017/0306621 A1 * 10/2017 Laursen ..... E04B 1/24
2017/0342736 A1 * 11/2017 Roshinsky ..... E04B 2/767
2021/0002894 A1 * 1/2021 Van De Voorde .... F16B 7/1454
2021/0207371 A1 * 7/2021 Van De Voorde ..... E04C 3/005

* cited by examiner

CONSTRUCTION UNIT FOR A FRAME

This invention relates to a construction unit for building up a frame, wherein the frame comprises at least two girders extending opposite one another and multiple uprights interconnecting these girders, wherein the construction unit comprises a first construction profile, a second construction profile and a third construction profile, wherein the second and the third construction profiles are each respectively connected to an end part of the first construction profile and that the first construction profile is provided to serve as an upright and the second and third construction profile are each provided to be part of a respective girder.

This invention also relates to a frame for a wall, comprising multiple such construction units successively interconnected and this invention also relates to a method for building up a frame, wherein multiple such construction units are provided.

Such construction units are typically used for building up inner walls from prefabricated materials. These construction units are interconnected so that they form a frame and against this frame, wall elements, such as plasterboards, multiplex panels, MDF panels, textile, etc. are provided, for forming an inner wall. These inner walls may serve as a partition, but may also serve as a facing wall or as a ceiling. If desired, between the construction units, insulating material may be provided to provide the inner wall with an insulating function.

For building up inner walls, traditionally use is made of profiles, being girders and uprights. When an upstanding inner wall is formed, one or more girders are placed on the floor, one or more girders are placed against the ceiling, and the girder(s) on the floor are connected to the girder(s) on the ceiling, and this is done using vertically placed uprights. These uprights and girders may, for example, be U-shaped profiles manufactured from metal. The drawback of this traditional construction is that these uprights and girders need to be interconnected on location, which takes up time and requires some skill. Further, the girders need to be connected well to the floor and the ceiling, respectively, and the uprights need to be placed at right angles, which is not always equally simple. In order to be able to connect the girder(s) to the ceiling, use needs to be made of a ladder or the like.

In order to build up inner walls more quickly, construction units are already used that comprise a first construction profile, a second construction profile and a third construction profile, wherein the first construction profile is provided to serve as an upright and the second and the third construction profile are each provided to be part of a respective girder. Here, these construction units form modules which are successively interconnectable. By working with these construction units instead of separate girders and uprights, a frame may be formed more quickly. The existing construction units usually have a rectangular shape and comprise two first construction profiles, one second construction profile and one third construction profile. Here, these construction units are successively placed against one another and interconnected to a frame. First construction profiles of successive construction units are abutting one another. A drawback is that relatively much material is needed in comparison with the traditional method to form a frame. An additional drawback with such rectangular construction units is that they are difficult to use in spaces surrounded by non-straight walls. This is because, with renovations, often not all walls are equally level and/or equally flat. When it is desired to place an inner wall, this means that an upright at the height of the wall will not always lean against the wall equally well. Since usually standard wall elements which are connected to one construction unit are used, an esthetical finishing of the inner wall at the height of this wall is not simple. This is because there is a (limited) space between the constructed wall and the wall. This space may be filled up, however, this filling up takes up time, is not simple and the result is often not esthetical.

It is therefore an object of the invention to manufacture construction units with which a frame for a wall may be constructed smoothly, quickly and efficiently, wherein this formed frame may comprise relatively little material and wherein a good finishing of the wall may be done more simply.

This object of the invention is achieved by providing a construction unit as described in the first paragraph of this description, wherein the construction unit comprises only one said first construction profile, one said second construction profile and one said third construction profile so that each construction unit is provided to form only one upright of the frame, that the second and the third construction profile each comprise a first and a second end extending opposite one another, wherein in use each said first end extends at a distance from the first construction profile and that multiple such construction units are provided to be successively interconnected such that the first end of the second construction profile of a said construction unit is connected to the second end of the second construction profile of a successive said construction unit and that the first end of the third construction profile of the first construction unit is connected to the second end of the third construction profile of the said successive construction unit so that the first construction profiles of successive construction units extend at a distance from one another.

The said construction profiles are usually elongated and therefore have two end parts/ends extending opposite one another. Such construction units are usable to construct an upstanding inner wall such as a partition or a facing wall. These construction units may, for example, also be used to form a ceiling. When such construction units are used to form an upstanding inner wall, the first construction profile is preferably provided to extend upstandingly. The second and the third construction profile are then, for example, provided to extend horizontally and parallel to each other, wherein the second construction profile extends at the bottom or at the top, respectively, and the third construction profile extends at the top or at the bottom, respectively. Preferably the first construction profile extends vertically during use.

With the aid of construction units according to the invention, a frame may simply and quickly be constructed, wherein the uprights all extend at a distance from one another. Since said first ends are connected to said second ends and, with the construction unit, a said first end operatively extends at a distance from the first construction profile. So, the first construction profiles of successive construction units cannot be located against one another but will extend at a distance from one another. This allows constructing a frame comprising relatively little material. Each second end may also be located at a distance from its respective first construction profile or may be located at the height of its respective first construction profile. Preferably, in use, the first end and the second end of each second construction profile substantially extend on both sides of the first construction profile so that the respective ends of successive construction units are simply interconnectable. Thus, for example, each second end may virtually abut the first construction profile in use, but still be located on the other side of the first construction profile than the corresponding first end.

An additional advantage is that such a construction unit is also very suitable to form a frame allowing construction of an esthetically looking wall, even if this wall leans against a wall which is not level and/or not flat. For this, proceedings may, for example, be as follows. A first construction unit is placed next to this wall so that the first construction profile is located at a distance from the wall and opposite the wall and the second and third construction profile virtually contact the wall or are at a limited distance from the wall. For this, if necessary, a part of the second and/or third construction profile may be removed. An additional profile and/or an end construction unit is/are provided to interconnect the second and third construction profile of the said construction unit at the height of the wall. The additional profile may be designed specifically for the construction unit, but may also be a profile according to the prior art. This additional profile or this additional end construction unit then forms an upright here which virtually abuts the wall and forms a square frame together with the first construction profile, (a part of) the second construction profile and (a part of) the third construction profile of the said construction unit. Thus, the end construction unit may have a [-shape in use. A wall element may easily be connected to this frame, wherein this wall element has been cut/made to the desired shape. For example, if an inner wall is constructed with plasterboards, a plasterboard may simply be cut to the desired size and thus be connected to this formed frame against which the cut plasterboard leans virtually completely, for example across virtually its complete height, against the wall. Preferably, standard construction units and standard rectangular wall elements will be provided here such as plasterboards, multiplex panels, MDF panels, textile, etc. These standard wall elements are provided to be connected to respective uprights at the height of two opposite edges, preferably extending successively. Two successive wall elements are then preferably connected to one and the same upright and extend next to each other. These wall elements may be provided so as to be attachable to the frame in all kinds of manners. For example, use may be made of screws, glue, hook-and-loop fasteners, double-sided tape, etc. The said square frame may be smaller than the dimension of a said standard wall element, such that a wall element may simply be sawn/cut and be connected to the said frame. Here, the wall element may be sawn such that there is virtually no space between the wall and the formed wall anymore. It is much simpler to saw a wall element to the desired size than to fill up the space between a formed wall and the wall, so that, with construction units according to the invention, an aesthetically looking wall may be constructed quickly and simply.

The said construction profiles may assume different forms, such as aluminium, steel, plastic or wood profiles. These may, for example, be cold-rolled, folded or extruded or sawn, etc. The construction profiles have, for example, virtually the same cross section across virtually their complete length. These construction profiles may be in one piece, or may, for example, comprise multiple profile parts which are, for example, slidable relative to one another.

The construction units may be built up such that they are compatible to already existing profiles used for building up walls.

In a specific embodiment, the second construction profile is connected to the first construction profile at the height of the second end of the second construction profile and/or the third construction profile is connected to the first construction profile at the height of the second end of the third construction profile. Thus, when used to construct a rectangular frame, the construction unit may, for example, have a [-shape or a U-shape in use.

In another embodiment, viewed in the direction of the first construction profile and in use, the first and the second end of the second construction profile extend on both sides of the first construction profile and each at a distance from the first construction profile and/or the first and second end of the third construction profile extend on both sides of the first construction profile and at a distance from the first construction profile. Thus, when used to construct a rectangular frame, the construction unit may, for example, have an I-shape in use.

Preferably, the length of the second construction profile and the length of the third construction profile are virtually equal. In said other embodiment, then preferably the second construction profile and the third construction profile are each connected to the first construction profile such that the distances from the said ends of the second and the third construction profile to the respective connections of the second and the third construction profile to the first construction profile are virtually equal. Standard construction units and therefore also standard wall elements may be provided here, so that building up a wall may be done very simply. Each standard wall element is preferably connected to two opposite first construction profiles so that successive wall elements are connected with one and the same first construction profile.

In a preferred embodiment, the second construction profile is hingeably connected to the first construction profile between at least a first position, wherein the second construction profile virtually extends according to the first construction profile and a second position, wherein the second construction profile virtually makes an angle of 90° to the first construction profile. To displace the second construction profile from the first position to the second position and vice versa, a force is needed. The construction unit may be provided so that once the construction profile is in its second position, an additional force is needed to get the second construction profile back to the first position. This is because, in use, the second construction profile will often be in the second position, since such construction units are often used to form rectangular frames. It is therefore not desirable that the second construction profile returns to its first position during use. Since the second construction profile is hingeably connected, it may be chosen which angle the second construction profile makes with respect to the first construction profile. This benefits the transportability of the construction unit. This also allows simple placement of a wall under a sloping roof, since here the construction units may be placed so that the frame constructed with the construction units has the shape of a triangle, a rectangular trapezium, an isosceles trapezium, etc.

Further preferably, in use, the construction unit virtually extends according to a plane and the second construction profile is rotatably connected to the first construction profile about an axis of rotation extending perpendicularly to this plane. This is a simple hingeable connection. Moreover, multiple such construction units are simply successively interconnectable to a frame extending according to the said plane.

Also further, preferably, the third construction profile is hingeably connected to the first construction profile between at least a first position, wherein the third construction profile virtually extends according to the first construction profile and a second position, wherein the third construction profile virtually makes an angle of 90° to the first construction profile. When both the second and the third construction profile are in their first position, the construction unit is very compact. In this manner, such construction units may be transported and stocked very compactly. Preferably, in use, the construction unit virtually extends according to a plane and the third construction profile is rotatably connected to the first construction profile about an axis of rotation extending perpendicularly to this plane.

In a preferred embodiment, the first construction profile is elongated and the first construction profile comprises two profile parts slidable relative to each other in the longitudinal direction of the first construction profile, so that the length of the first construction profile is settable. By working with a first construction profile whose length is settable, a frame with the desired dimensions may simply be provided, such as for example the desired height. Also, the construction unit may simply be clamped between, for example, a floor and a ceiling, so that the attachment of the second and the third construction profile to, for example, the floor and the ceiling, respectively, needs to be less robust or is even redundant. Preferably, the second and the third construction profile will still be attached to the wall, the ceiling or the floor, against which they abut. However, a strong connection need not be provided, since the frame may be clamped here, so that one or a few screws or hook-and-loop fasteners (Velcro), or double-sided adhesive tape will be sufficient. If hook-and-loop fasteners or double-sided adhesive tape is used, for example, first the second construction profile or the third construction profile, respectively, may be connected to the floor, after which, during displacing the respective profile part of the first construction profile upwards, the third construction profile or the second construction profile, respectively, is connected to the ceiling. When no use is made of screws, or only few screws are used, it is furthermore possible to remove the obtained frame again and to reuse the construction units at a different location. Since circular economy is becoming increasingly important, the possible reuse of the construction units is an advantage.

Further, preferably, the two profile parts are telescopically displaceable relative to each other. In order to provide these profile parts to be telescopically displaceable relative to each other, one of the two profiles preferably comprises a cavity into which at least a part of the other profile part is slidably providable in this cavity via an end side. The one profile part may, for example, have a U-shaped cross section, while the other profile part comprises a smaller U-shaped cross section which is shaped to fit into the one profile part.

Further, preferably, the first construction profile comprises fixing means for fixing the profile parts with respect to each other. These fixing means may, for example, comprises a snap fastener so that, in a very simple manner, the two profile parts will be displaced and fixed, without hand tools being required. With the aid of a snap fastener, it is simple to provide profile parts telescopically displaceable relative to one another across a relatively large distance, wherein the profile parts may be fixed in any position relative to one another. In an embodiment wherein the construction unit is provided to be clamped between two wall parts, such as a floor and a ceiling, the construction unit may simply be clamped between the two wall parts so that it is not necessary to (robustly) connect the construction unit to the wall parts. For example, hook-and-loop fasteners and/or double-sided adhesive tape is sufficient here to attach the second and the third construction profile to the respective wall parts, since the construction unit is clamped between the wall parts.

In a specific embodiment, the second construction profile is built up such that multiple such construction units are successively interconnectable, such that respective ends of second construction profiles of successive construction units overlap. Since the ends of successive second construction profiles overlap, a robust connection is obtained between successive construction units, so that the obtained frame is also robust. The ends may, for example, snap into each other, or the one end may be clamped into the other end, or the one end may be slid into the other end. In principle, additional connecting elements, such as screws, hook-and-loop fasteners, etc. need not be provided. If desired, however, additional connecting elements may be provided.

Further, preferably, in this specific embodiment, the third construction profile is built up such that multiple such construction units are successively interconnectable, such that respective ends of third construction profiles of successive construction units overlap. With such construction units, a very robust frame may be obtained.

In a preferred embodiment, the ends of the second construction profile are built up such that respective ends of second construction profiles of successive construction units are engageable into one another for connecting the successive construction units. Then the second construction profile is built up such that multiple such construction units are thus successively connectable, so that the one end of the respective ends of second construction profiles of successive construction units is receivably connectable into the other end of the respective ends of second construction profiles of successive construction units.

Further, preferably, the ends of the third construction profile are built up such that respective ends of third construction profiles of successive construction units are engageable into one another for connecting the successive construction units. The third construction profile is built up such that multiple such construction units are successively interconnectable such that the one end of the respective ends of third construction profiles of successive construction units is receivably connectable into the other end of the respective ends of third construction profiles of successive construction units.

Further, preferably, the first end of the second and/or the third construction profile comprises a cavity and the second end of the second and/or the third construction profile comprises one or more clamping elements or vice versa, wherein the one or more clamping elements are snappably receivable in a said cavity. Such construction units are very simply interconnectable and this is done by clamping ends into one another. This allows simple and quick interconnection of multiple construction units without hand tools and/or additional fastening elements such as screws being needed. Of course, use may still be made of additional fastening elements.

In a very specific embodiment, the construction unit comprises the following features:

the second construction profile is hingeably connected to the first construction profile between at least a first position, wherein the second construction profile virtually extends according to the first construction profile and a second position, wherein the second construction profile virtually makes an angle of 90° to the first construction profile. Preferably, in use, the construction unit virtually extends according to a plane and the second construction profile is rotatably connected to the first construction profile about an axis of rotation extending perpendicularly to this plane;

the first construction profile is elongated and comprises two profile parts slidable relative to each other in the longitudinal direction of the first construction profile, so that the length of the first construction profile is settable;

the ends of the second construction profile are built up such that respective ends of second construction profiles of successive construction units are engageable into one another for connecting the successive construction units.

This unique combination of above-mentioned three features ensures that a frame comprising such construction units is very simple to build up and this can be done by one person and without hand tools. This is because, here, only a construction unit needs to be placed at the desired location with respect to an already placed construction unit and the two profile parts of the first construction profile need to slide apart. When the second construction profile is then provided to extend at the top, then the second construction profile will automatically contact the second construction profile of the already placed construction unit and connect thereto. In the situation wherein the second construction profile is not yet in the desired position, upon further sliding apart of the said profile parts, this second construction profile will then rotate further until the second construction profile assumes the desired position. This unique combination ensures that building up frames almost amounts to nothing. This is because interconnecting the second construction profiles and then placing each second construction profile in the desired position automatically happens when the profile parts of the first construction profile are slid apart.

Further, preferably therefore the third construction profile is hingeably connected to the first construction profile between at least a first position, wherein the third construction profile virtually extends according to the first construction profile and a second position, wherein the third construction profile virtually makes an angle of 90° to the first construction profile, so that each construction profile may be transported/stocked very compactly and/or the ends of the third construction profile are built up such that respective ends of third construction profiles of successive construction units are engageable into one another for connecting the successive construction units, so that placing the construction unit at the desired position may be done very smoothly.

Further, preferably, the first construction profile comprises fixing means for fixing the profile parts with respect to each other. These fixing means preferably comprise a snap fastener so that, in a very simple manner, the two profile parts will be displaced and fixed with respect to each other, without hand tools being required for this. In an embodiment wherein the construction unit is provided to be clamped between two wall parts, such as a floor and a ceiling, the construction unit may simply be clamped between the two wall parts so that it is not necessary to (robustly) connect the construction unit to the wall parts.

In a preferred embodiment, in use, the construction unit virtually extends according to a plane and the first construction profile has an H-shaped cross section or a U-shaped cross section across virtually its entire length, so that the first construction profile comprises two opposite U-shaped gutters or one U-shaped gutter, wherein each said gutter is reachable via a respective opening extending virtually perpendicularly to the said plane. When multiple such construction units are interconnected to a frame, this means that the space between the successive first construction profiles may simply be filled up with insulating material such as glass wool. With the aid of such construction units it is therefore simple to construct walls which are sound-insulating and/or heat-insulating. By working with an H-shaped or U-shaped cross section, there is, moreover, a sufficiently robust first construction profile and this without the first construction profile comprising too much material. Such profiles may simply be obtained via extrusion, for example if the first construction profile comprises two said profile parts, by manufacturing these two profile parts via extrusion.

Preferably the second and/or the third construction profile has a U-shaped cross section, so that the second and/or the third construction profile comprises a U-shaped gutter, wherein the respective end part of the first construction profile is in this gutter to connect the first construction profile to the second and/or the third construction profile. By providing the first construction profile in the said gutter, the connection between the first construction profile and the second and/or the third construction profile may be designed robustly. In addition, this means that the space between the second and the third construction profile may simply be filled up with insulating material such as glass wool. So, with the aid of such construction units, walls which are sound-insulating and/or heat-insulating may simply be formed. Furthermore, working with a U-shaped cross section yields a sufficiently robust second and/or third construction profile and this without the second and/or the third construction profile comprising too much material. Such profiles may simply be obtained via extrusion.

In an alternative embodiment, the first and/or the second and/or the third construction profile virtually have a s-shape or a W-shape. With the aid of such formed profiles, acoustic walls may simply be formed.

Further, preferably, in the embodiment where the second and/or the third construction profile is hingeably connected to the first construction profile between at least a first position, wherein the second and/or the third construction profile virtually extends according to the first construction profile and a second position, wherein the second and/or the third construction profile virtually makes an angle of 90° to the first construction profile, the width of the latter U-shaped gutter is larger than the corresponding dimension of the portion of the first construction profile extending in the proximity of the respective end part, wherein, in the first position, this said portion extends in the U-shaped gutter. Due to the presence of this U-shaped gutter, the first construction profile may partially extend in this gutter. When the second and/or the third construction profile extends here according to the first construction profile, the construction unit is very compact, which is ideal for transport and stockage. When the second construction profile is connected to the first construction profile at the height of the second end of the second construction profile and also the third construction profile is connected to the first construction profile at the height of the second end of the third construction profile, the length of the construction unit, when both the second and the third construction profile are in their first position, is substantially determined by the length of the first construction profile so that, with this design, the construction unit may be brought into a very compact state.

In a very preferred embodiment, the respective ends of second construction profiles of successive construction units are snappably interconnectable and/or the respective ends of third construction profiles of successive construction units are snappably interconnectable. Thus, construction units may simply be successively interconnected without needing hand tools and/or additional fastening elements such as screws. Of course, use may still be made of additional fastening elements.

This invention also relates to a frame for a wall comprising multiple above-mentioned construction units successively interconnected. This frame may additionally comprise end construction units and/or additional profiles as described hereinabove.

This invention also relates to a method of building up a frame, wherein multiple above-mentioned construction units are provided and these construction units are successively interconnected.

This invention will now be explained in more detail with reference to the following detailed description of a preferred embodiment of a construction unit according to this invention. The intention of this description is exclusively to give elucidating examples and to indicate further advantages and particulars of this invention, and may by no means be interpreted as a limitation of the field of application of the invention or of the patent rights claimed in the claims.

In this detailed description, reference numerals are used to refer to the appended drawings, wherein FIG. 1 is a front view of a construction unit according to a first embodiment of the invention, wherein the construction unit is in a first operative position;

Figure 7:
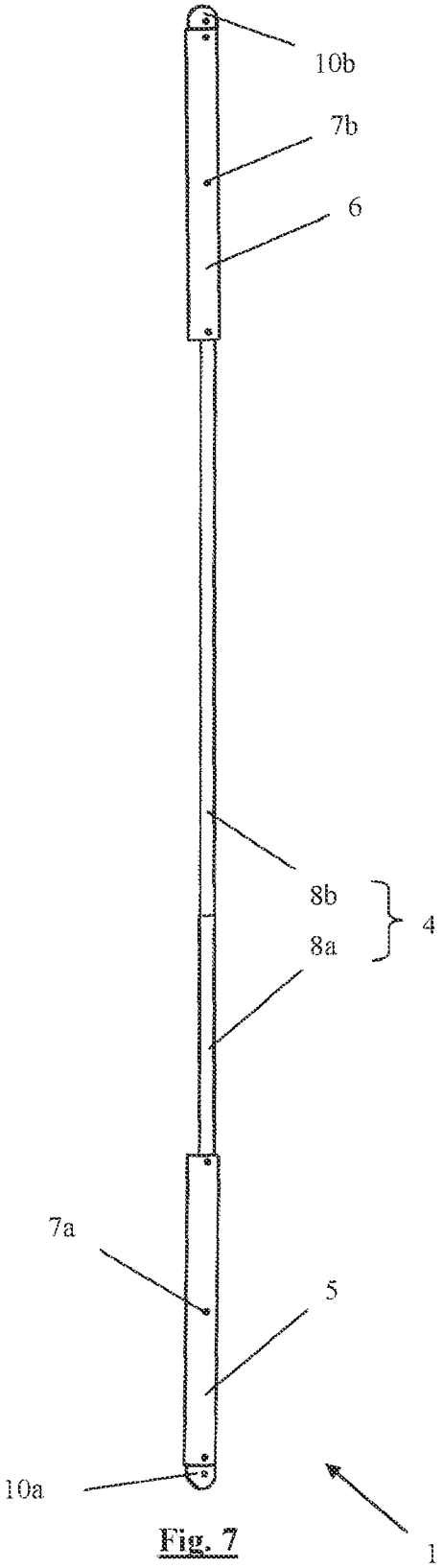
FIG. 7 is a front view of the construction unit shown in FIG. 1, wherein the construction unit is in a transport position.
Figure 8:
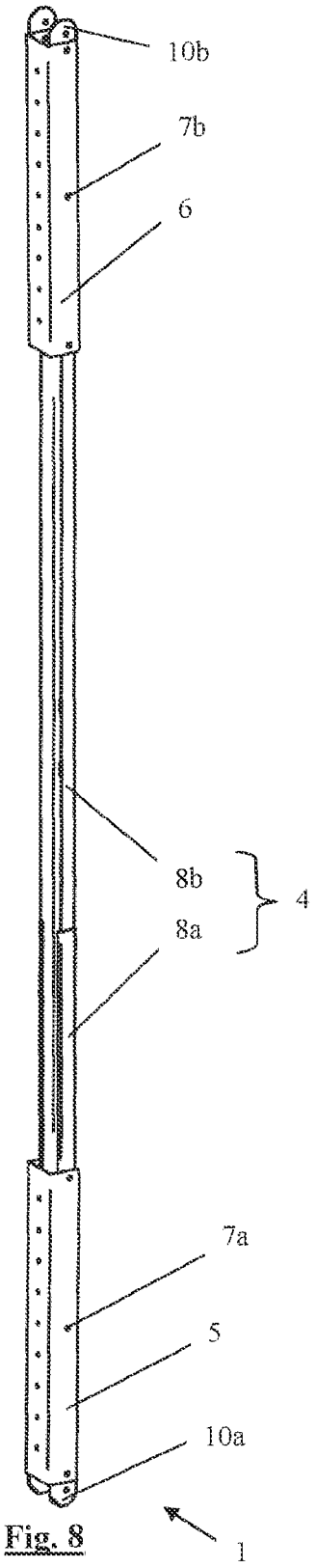
FIG. 8 is a perspective representation of the construction unit shown in FIG. 1, wherein the construction unit is in the transport position.
Figure 9:
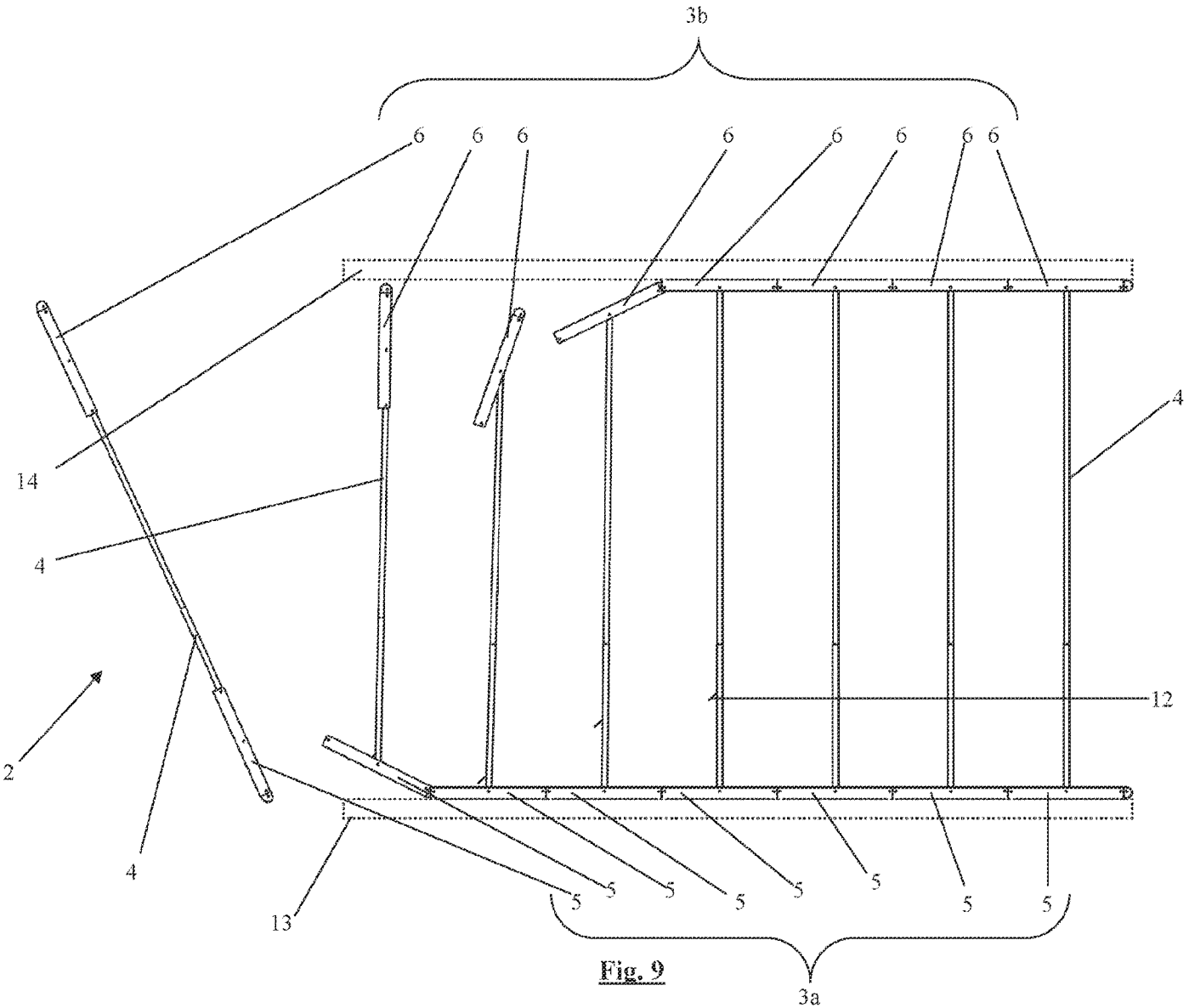
FIG. 9 is a front view of a frame according to the invention comprising multiple construction units as shown in FIGS. 1-8, during building up of the frame.
Figure 10:
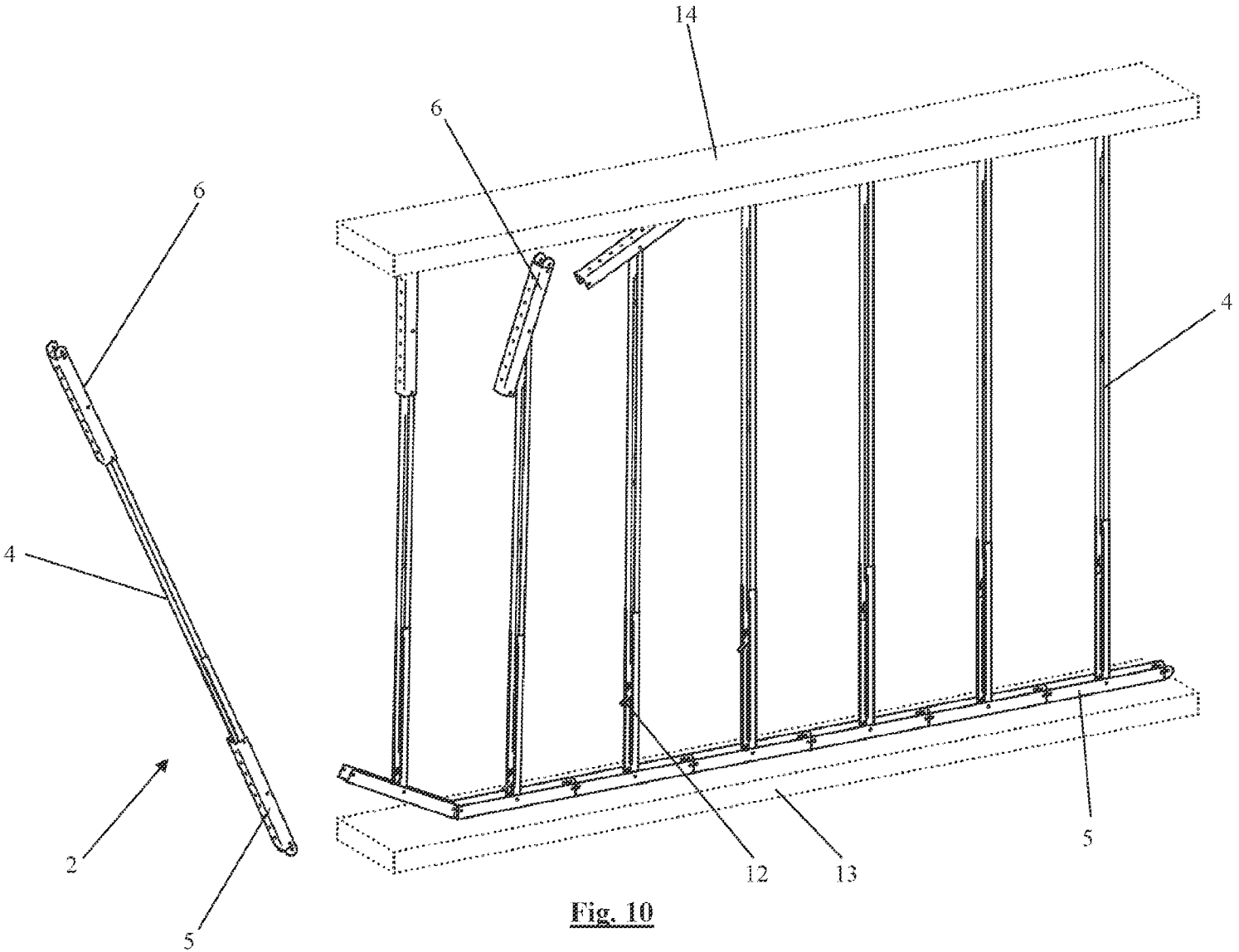
FIG. 10 is a perspective representation of the frame show in FIG. 9.
Figure 11:
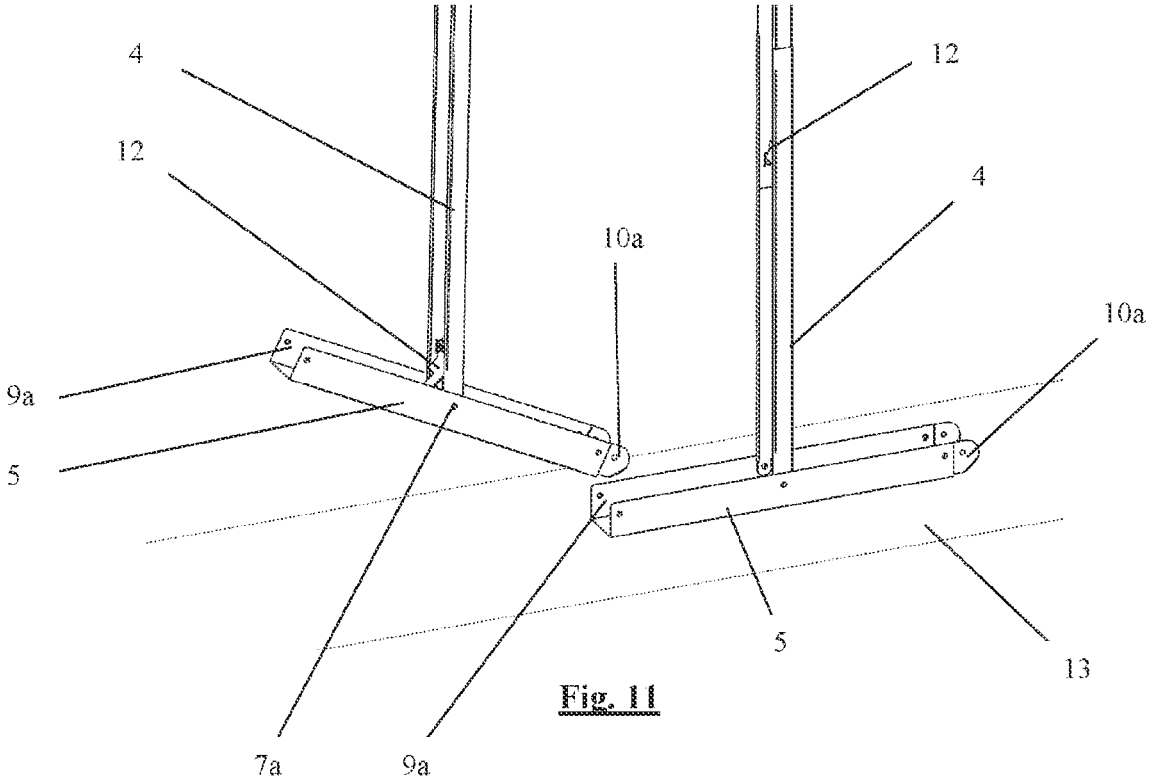
FIG. 11 is a detailed perspective representation of two construction units according to the first embodiment, during interconnection of these construction units.
Figure 12:
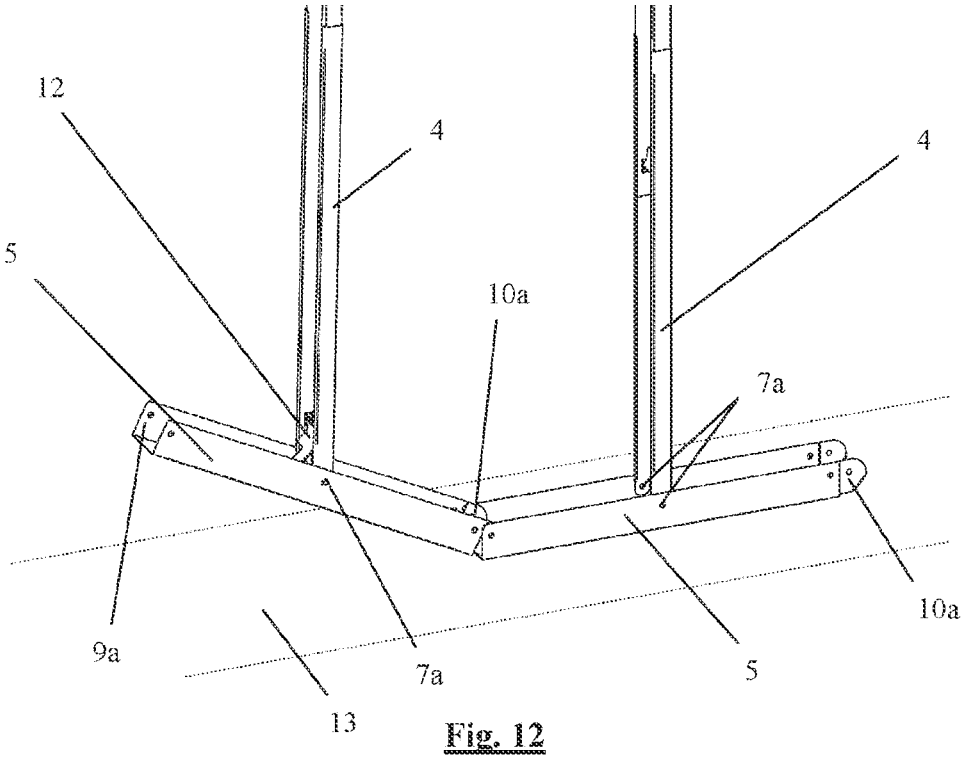
FIG. 12 is a detailed perspective representation of two construction units according to the first embodiment, during further interconnection of these construction units.
Figure 13:
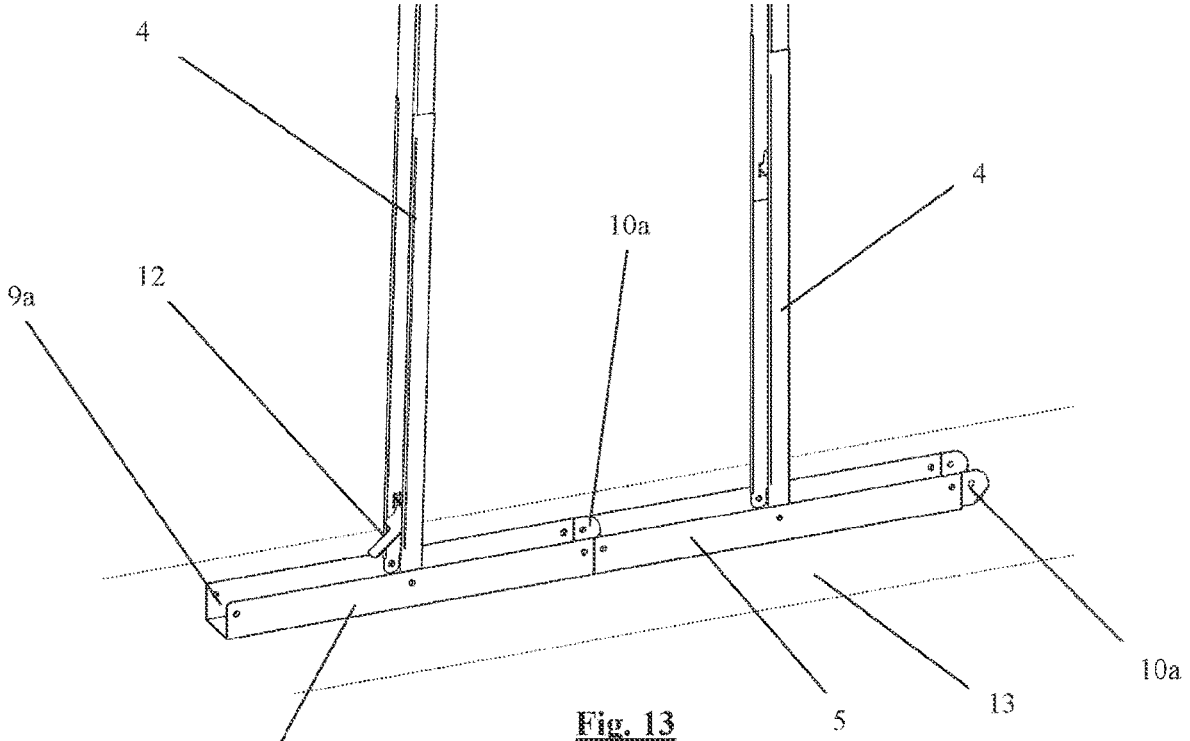
FIG. 13 is a detailed perspective representation of two construction units according to the first embodiment, after they have been interconnected.
Figure 14:
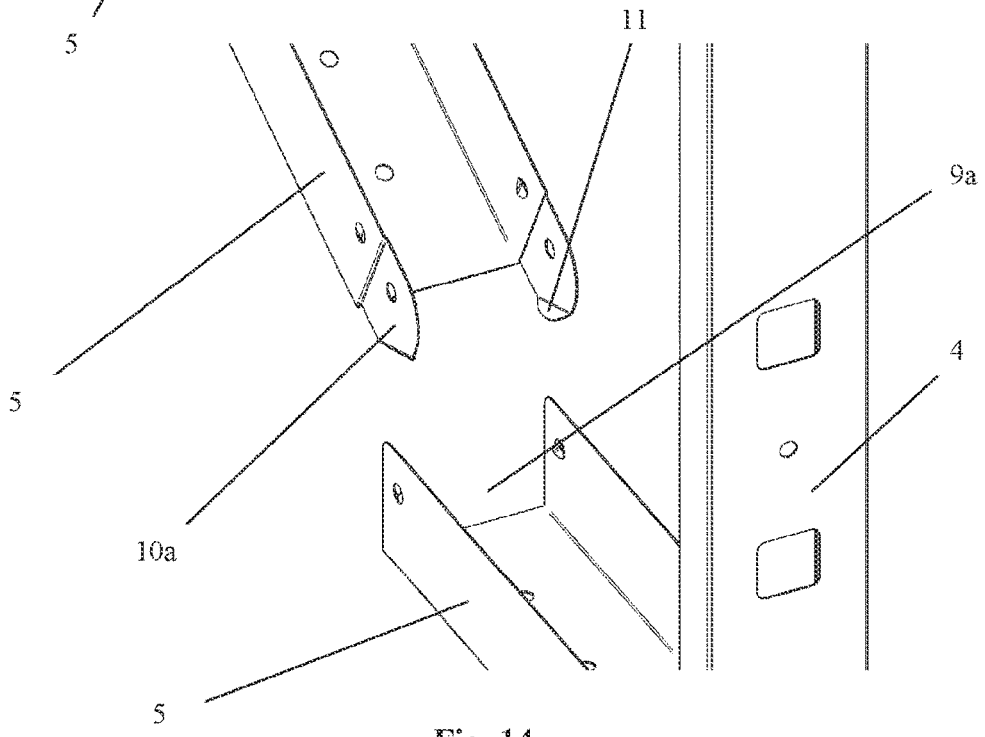
FIG. 14 is a further detailed view of what has been shown in FIG. 11.
Figure 15:
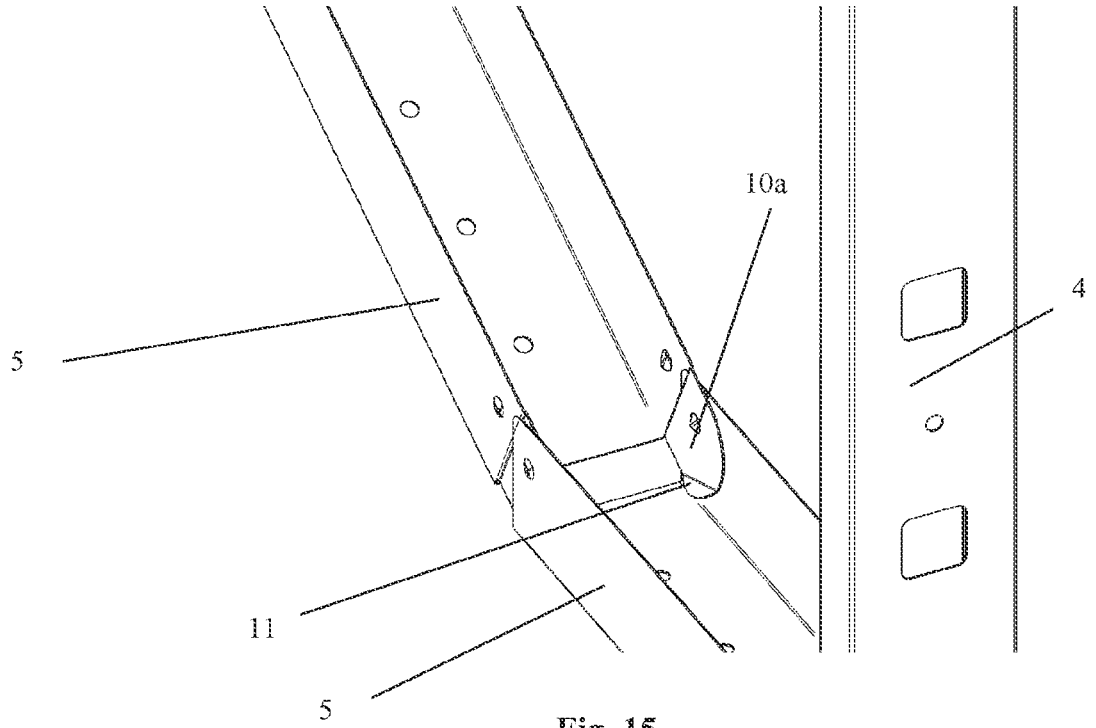
FIG. 15 is a further detailed view of what has been shown in FIG. 12.
Figure 16:
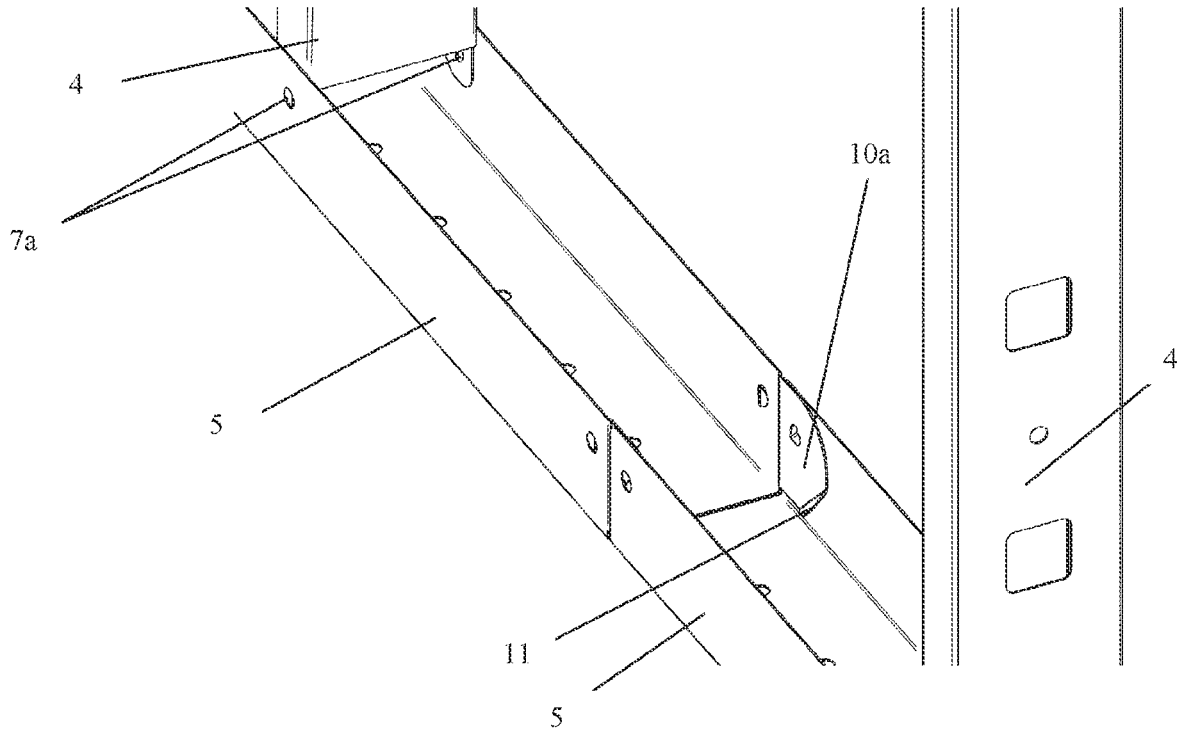
FIG. 16 is a further detailed view of what has been shown in FIG. 13.
Figure 17:
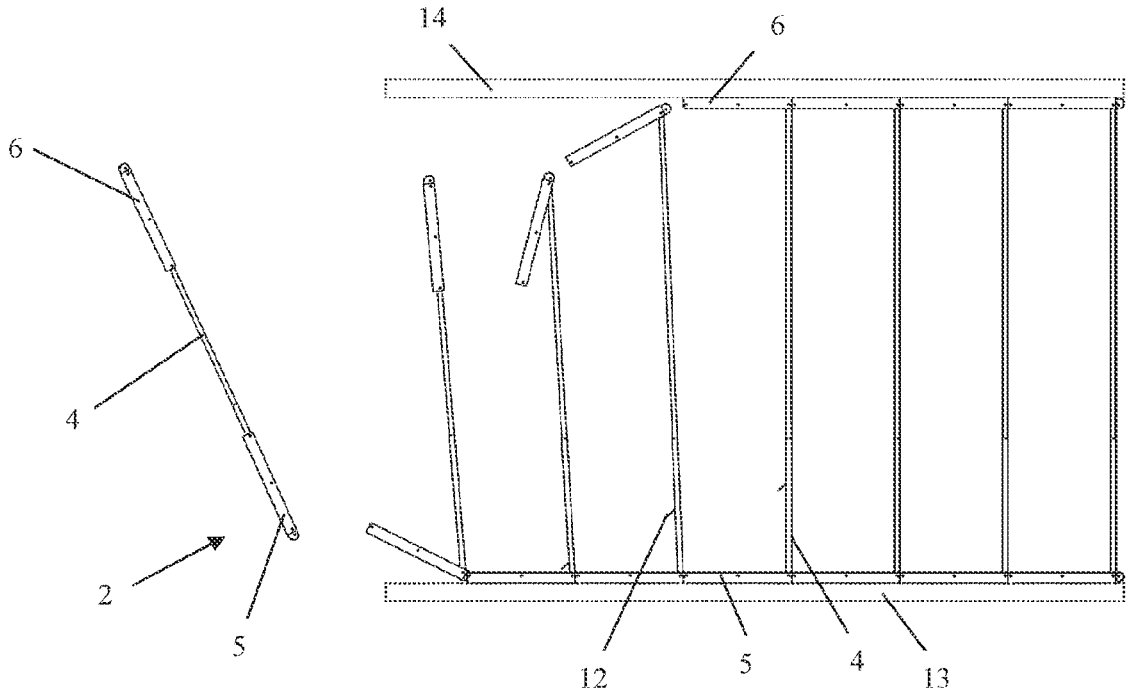
FIG. 17 is a front view of a frame according to the invention comprising multiple construction units according to a second embodiment of the invention, during building up of the frame.
Figure 18:
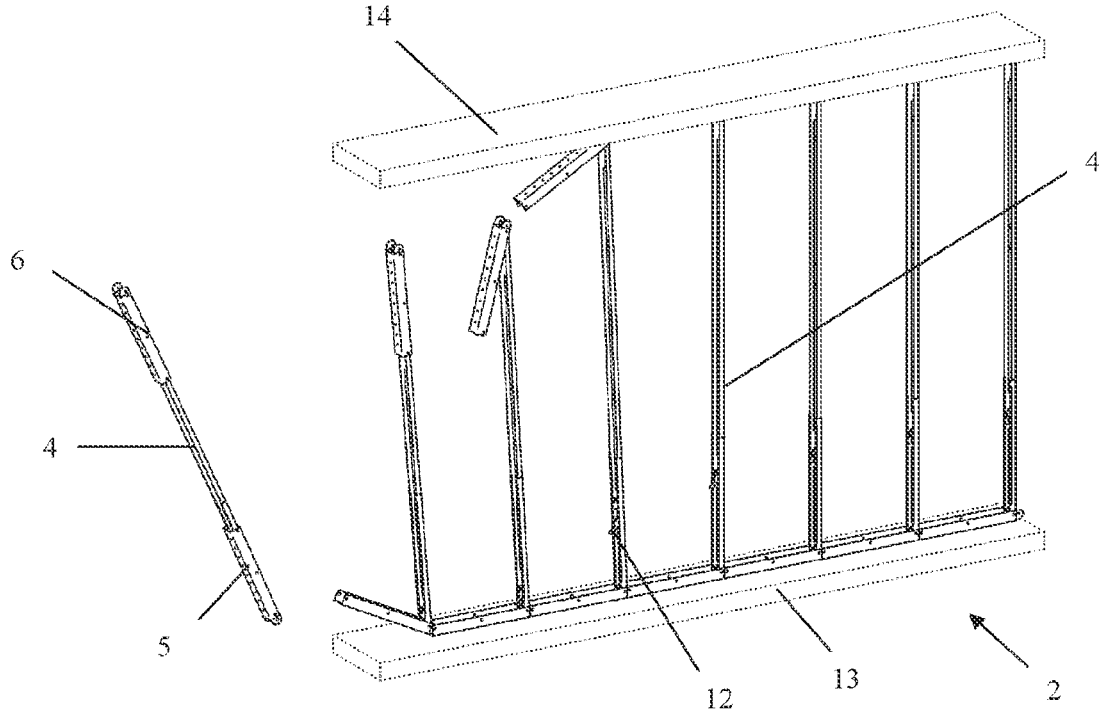
FIG. 18 is a perspective representation of what has been shown in FIG. 17.
Figure 19:
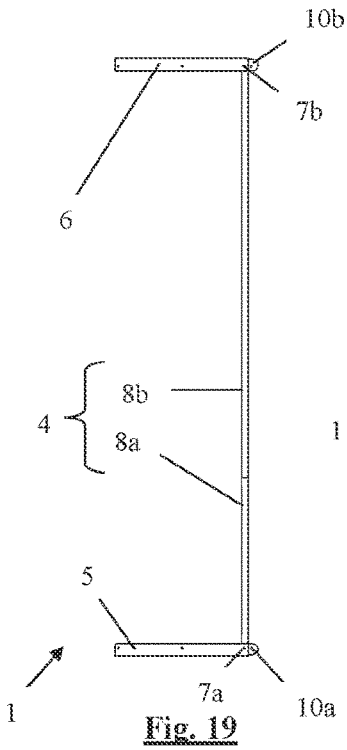
FIG. 19 is a front view of a construction unit according to the second embodiment, wherein the construction unit is in a first operative position.
Figure 20:
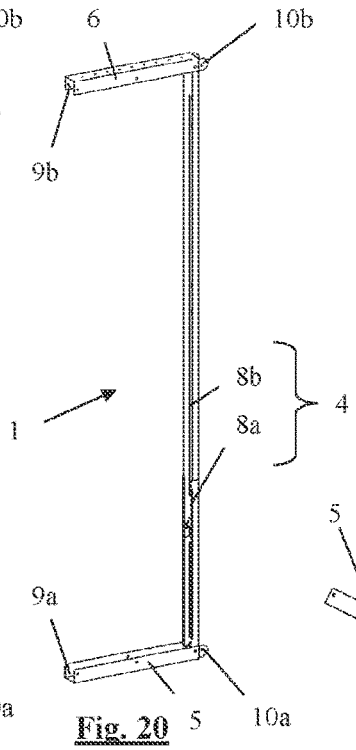
FIG. 20 is a perspective representation of the construction unit shown in FIG. 19, wherein the construction unit is in the first operative position.
Figure 21:
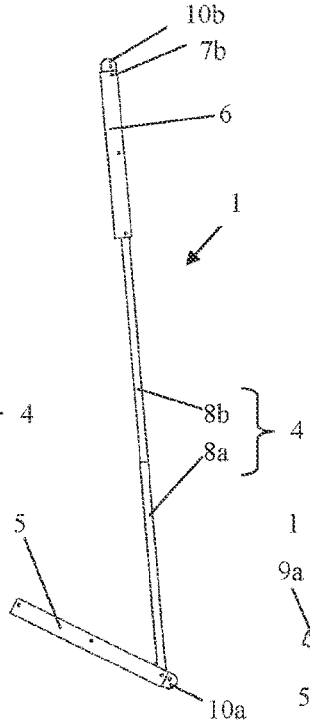
FIG. 21 is a front view of the construction unit shown in FIG. 19, during placing of the construction unit.
Figure 22:
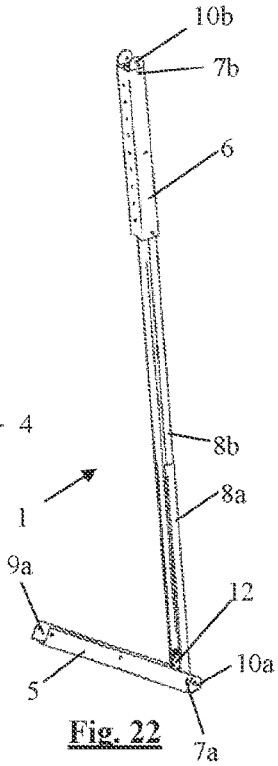
FIG. 22 is a perspective representation of the construction unit shown in FIG. 19, during placing of the construction unit.
Figure 23:
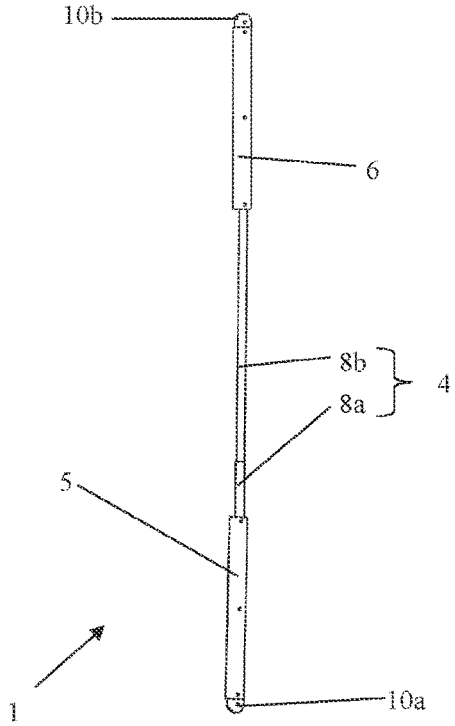
FIG. 23 is a front view of the construction unit shown in FIG. 19, wherein the construction unit is in a transport position.
Figure 24:
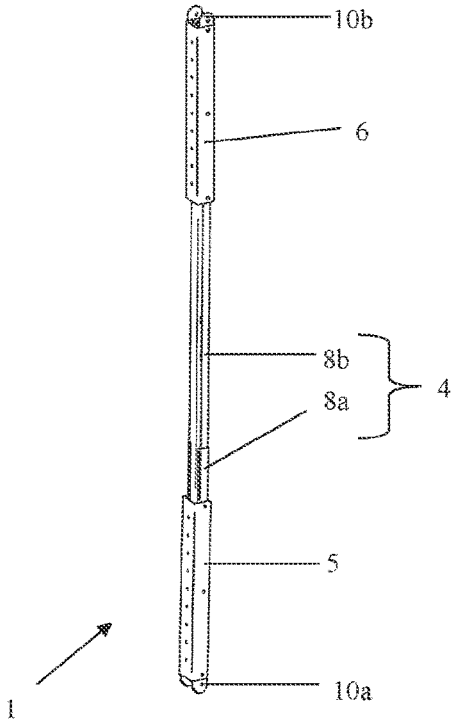
FIG. 24 is a perspective representation of the construction unit shown in FIG. 19, wherein the construction unit is in the transport position.

The construction units (1) as shown in FIG. 1-8 are used to form a frame (2) of an inner wall. In FIGS. 9 and 10, such a frame (2) is shown during building up thereof. In FIGS. 11-16 the connection between two construction units (1) is shown in detail. Above-mentioned figures show a first type of standard construction unit (1). FIGS. 17-24 show a second type of a standard construction unit (1).

Each construction unit (1) comprises one first construction profile (4), one second construction profile (5) and one third construction profile (6). Each first construction profile (4) is elongated and has a U-shaped cross section. Further, the first construction profile (4) is built up from two profile parts (8*a*, 8*b*) with a U-shaped cross section. These two profile parts (8*a*, 8*b*) are telescopically slidable relative to each other. The one profile part (8*a*) is designed to be slightly wider than the other profile part (8*b*), so that the other profile part (8*b*) is slidably receivable in the one profile part (8*a*). The first construction profile (4) further comprises a snap fastener (12) to fix the two profile parts (8*a*, 8*b*) with respect to each other. The second and the third construction profile (5, 6) are each respectively connected to an end part of the first construction profile (4). This specifically means that the second construction profile (5) is connected to the one profile part (8*a*) while the third construction profile (6) is connected to the other said profile part (8*b*).

The length, the shape and the dimensions of the second construction profile (5) virtually correspond to the length, the shape and the dimensions of the third construction profile (6). The second and the third construction profile (5, 6) have a virtually U-shaped cross section and therefore have a U-shaped gutter. Further, they have a first end which does not deviate from the U-shape and therefore comprises a cavity (9*a*, 9*b*) and they also have a second end located opposite this first end, wherein this second end comprises two clamping elements (10*a*, 10*b*) extending in the longitudinal direction of the second and the third construction profile (5, 6), respectively. With the first type, each end part of the construction profile (4) is received centrally and therefore at a virtually equal distance from the first and the second end in the gutter of the second and the third construction profile (5, 6), respectively, and this according to a connection (7*a*, 7*b*) allowing a rotation of the second and the third construction profile (5, 6), respectively, relative to the first construction profile (4). With each second type, each end part of the first construction profile (4) is, at the height of the second end, received in the gutter of the second and the third construction profile (5, 6), respectively and this according to a connection (7*a*, 7*b*) allowing a rotation of the second and the third construction profile (5, 6), respectively, relative to the first construction profile (4). With both types, the first ends and the second ends extend on both sides of the first construction profile (4) in use.

Since the second and the third construction profile (5, 6) are rotatably connected to the first construction profile (4) and the length of the first construction profile (4) is adjustable, the construction unit (1) may assume many different positions. Thus, the construction unit (1) may assume a first position, wherein the construction unit (1) takes up a minimum volume so that this first position is mainly used to transport and/or to stock the construction unit (1). This first position is shown in FIGS. 7 and 8 and in FIGS. 23 and 24. The length of the first construction profile (4) is minimal here and both the second and the third construction profile (5, 6) extend according to the first construction profile (4). The portions of the profile parts (8*a*, 8*b*) at the height of the end parts extend in the gutter of the second and the third construction profile (5, 6), respectively. This is possible because the second and the third construction profile (5, 6) are slightly wider than the respective profile parts (8*a*, 8*b*). Since, with the second type, the second and the third construction profile (5, 6) extend virtually completely around the first construction profile (4) in the first position, this second type is more compact in the first position than the first type.

Figure 1:
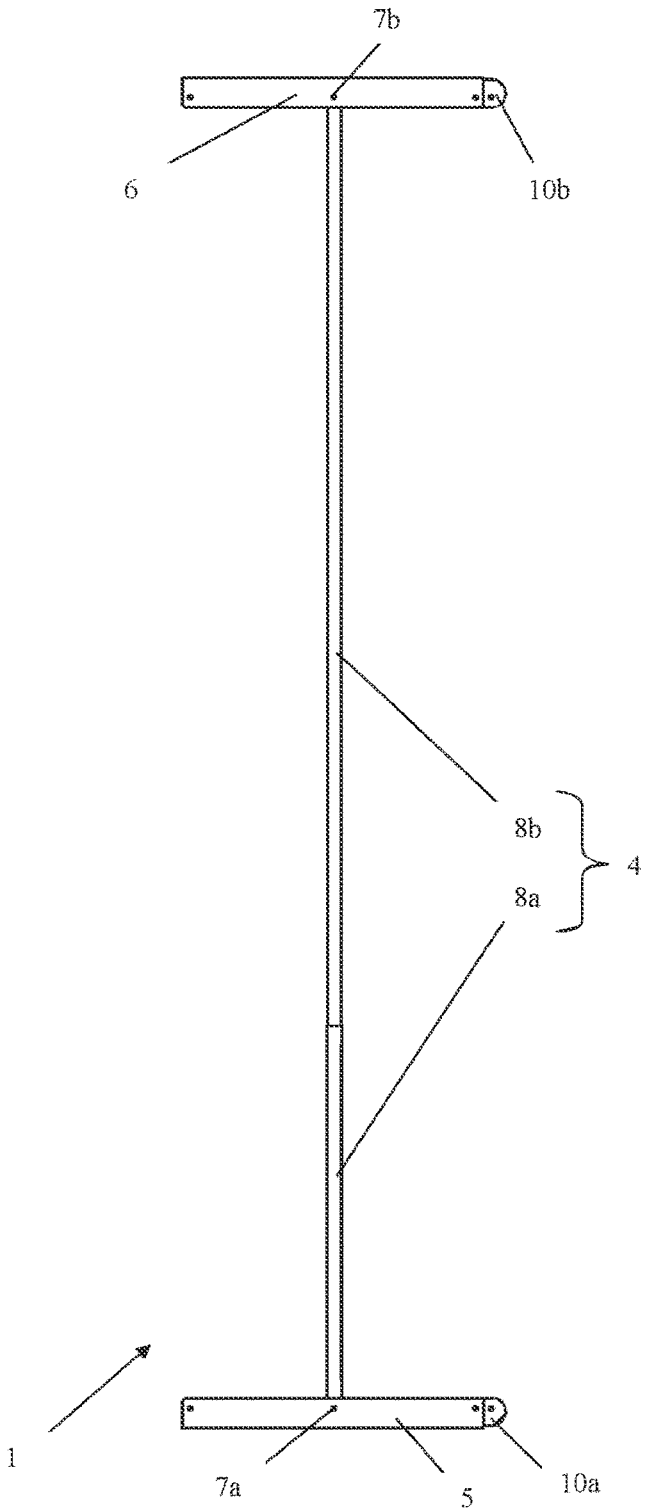
Figure 2:
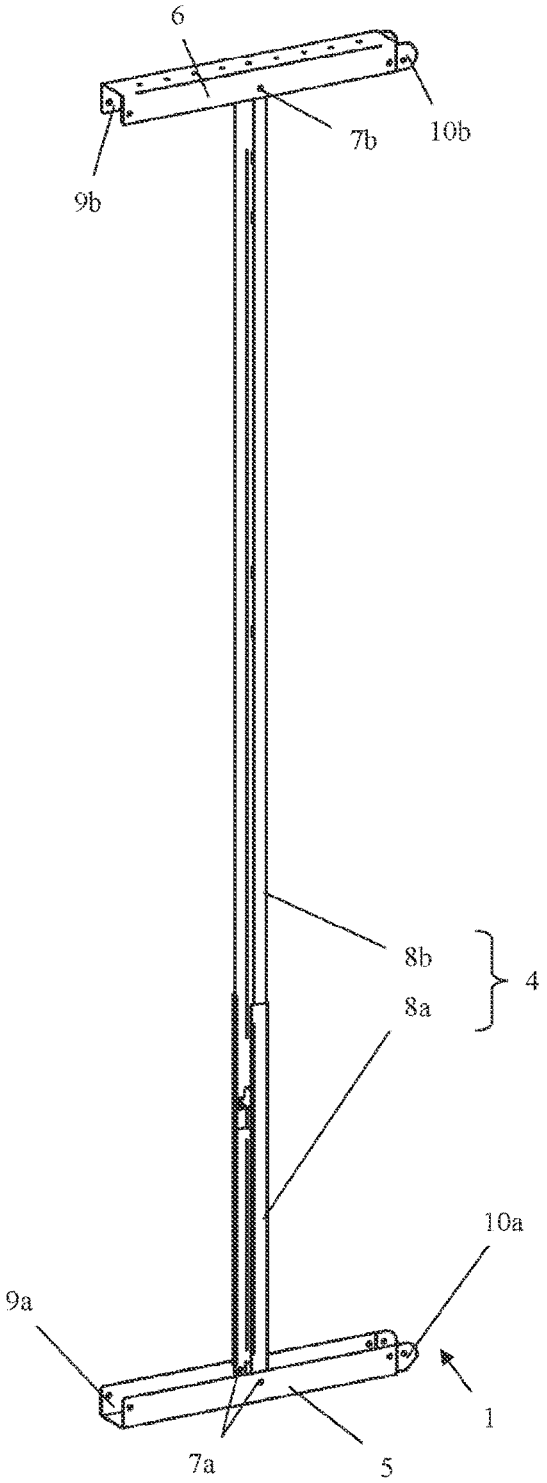
FIG. 2 is a perspective representation of the construction unit shown in FIG. 1, wherein the construction unit is in the first operative position.
Figure 3:
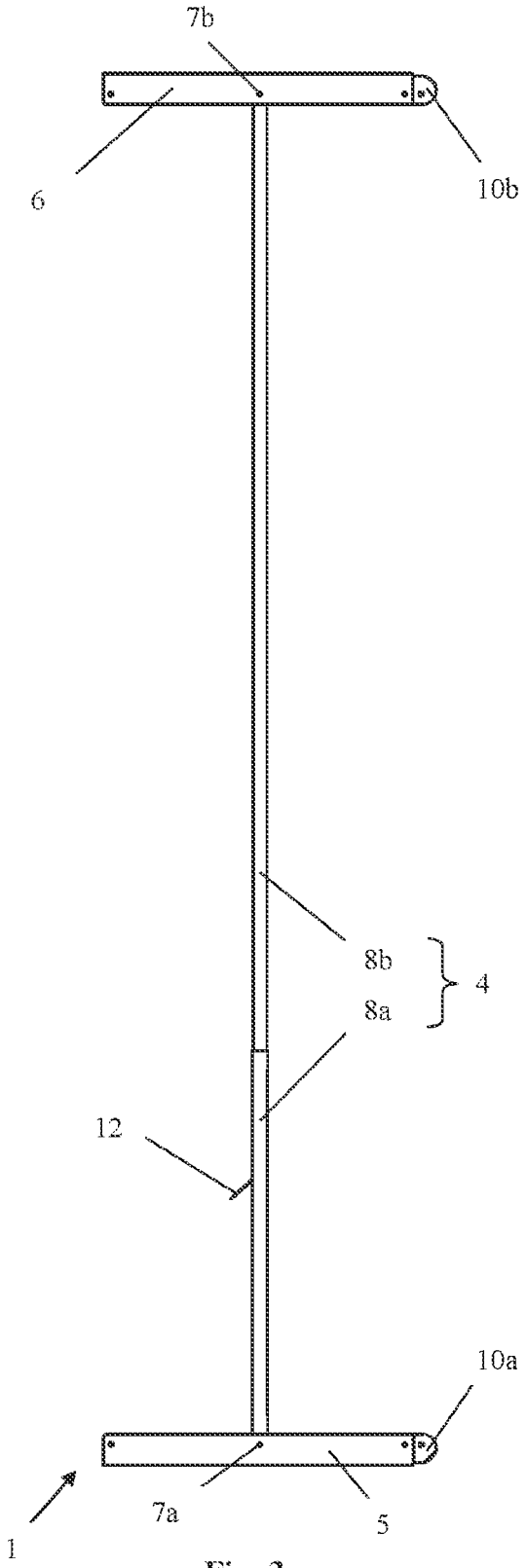
FIG. 3 is a front view of the construction unit shown in FIG. 1, during lengthening of the first construction profile.

A second position is a position of use wherein the length of the first construction profile (4) is not minimal and both the second and the third construction profile (5, 6) make an angle of virtually 90° to the first construction profile (4). In this second position, the construction unit (1) has a I-shape for the first type and a [-shape for the second type. This second position is shown in FIGS. 1 and 2 and in FIGS. 19 and 20. In FIGS. 3-6 and in FIGS. 21 and 22, positions are shown which the construction unit (1) temporarily assumes during the conversion from the first position to the second position. Thus, in FIG. 3, it is, for example, visible that the snap fastener (12) has not been tightened yet.

Such construction units (1) are used to form a frame (2) for a wall, such as a facing wall or a non-bearing partition. As shown in FIGS. 9 and 10 and in FIGS. 17 and 18, different construction units (1) are successively interconnected for this. FIGS. 9 and 10 show how such a frame (2) is placeable between a floor (13) and a ceiling (14) both extending horizontally. However, this frame (2) may, for example, also be placed under a sloping ceiling.

Figure 4:
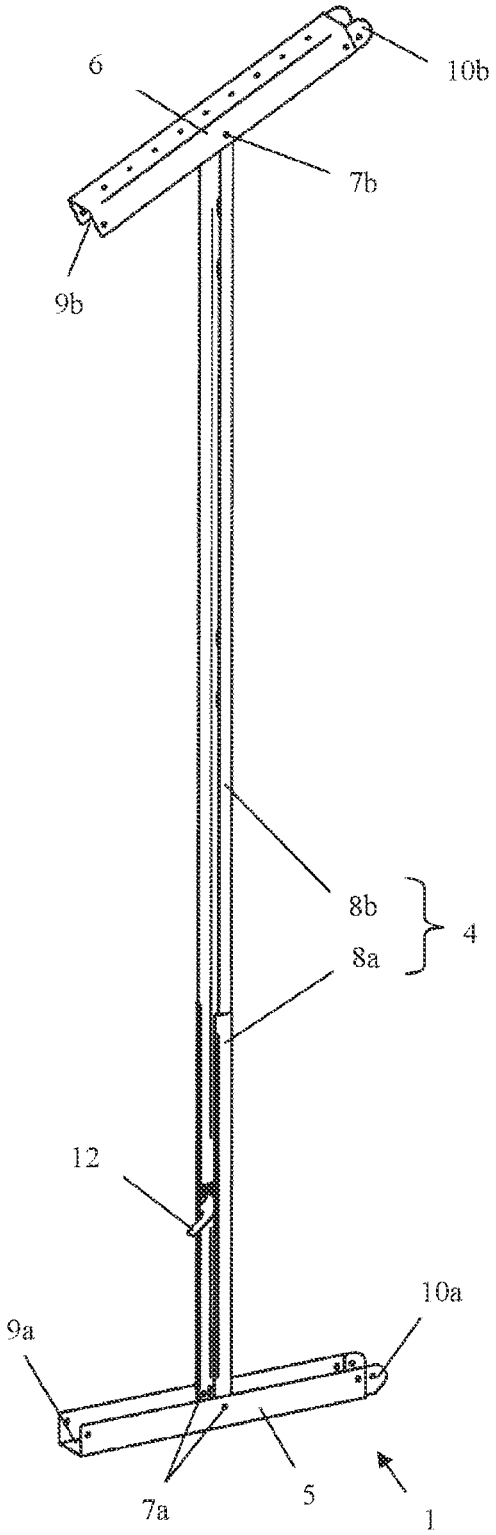
FIG. 4 is a perspective representation of the construction unit shown in FIG. 1, during lengthening of the first construction profile.
Figure 5:
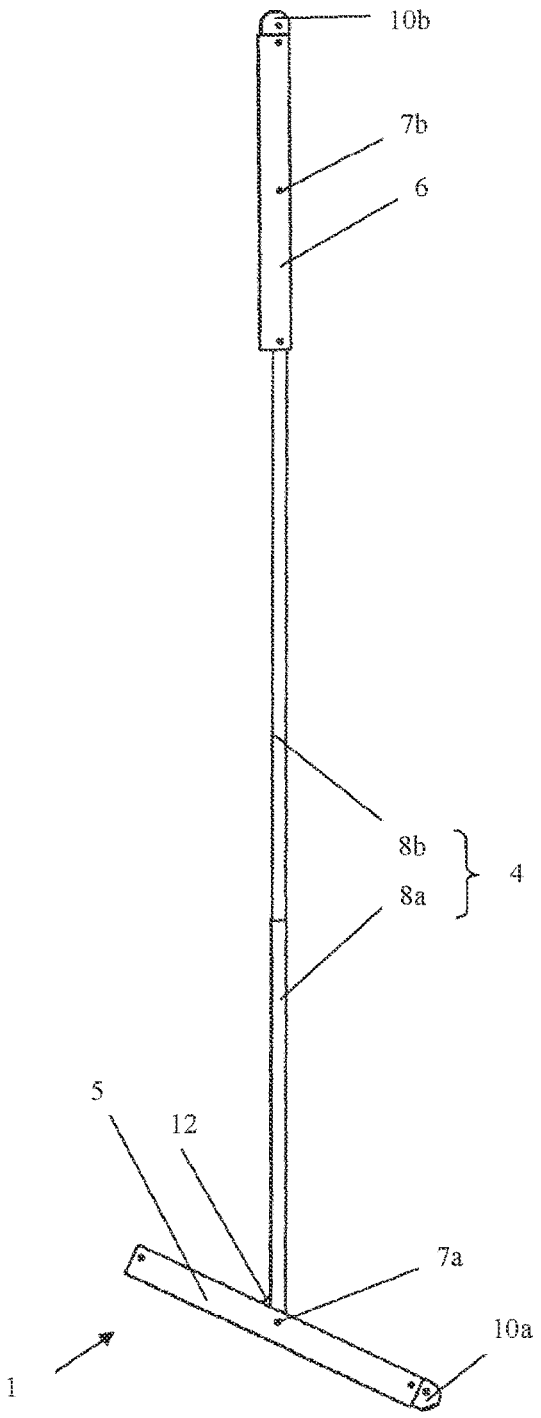
FIG. 5 is a front view of the construction unit shown in FIG. 1, during placing of the construction unit.
Figure 6:
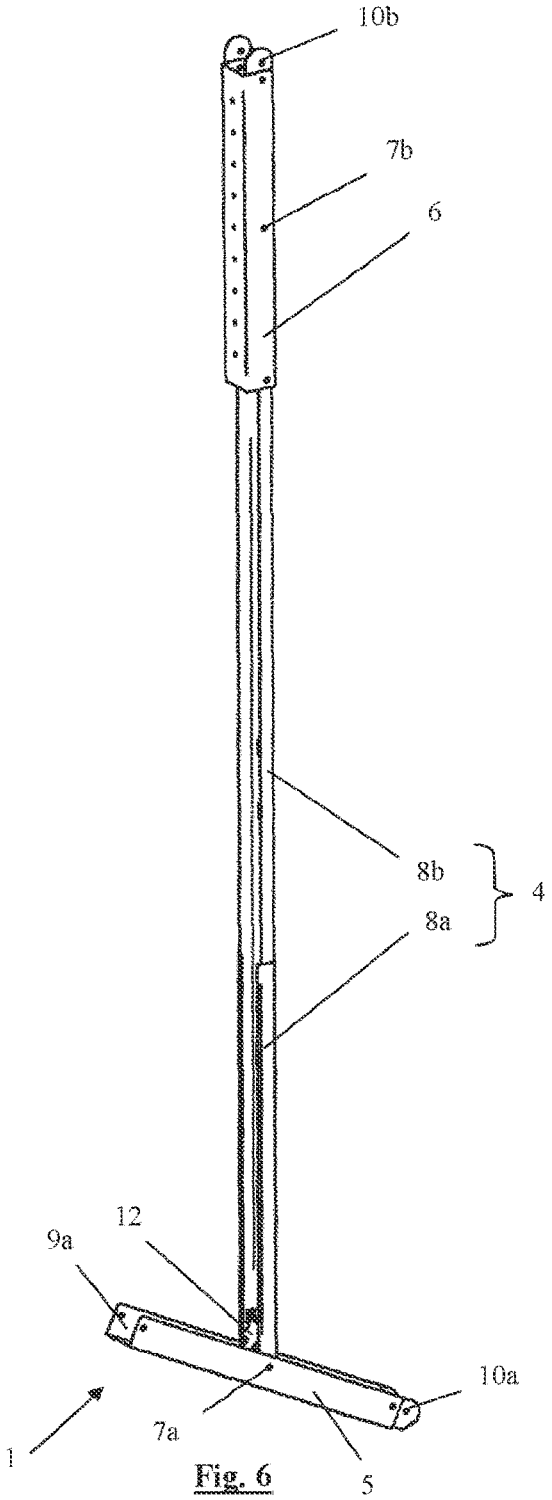
FIG. 6 is a perspective representation of the construction unit shown in FIG. 1, during placing of the construction unit.

For the sake of simplicity, the placement of the frame (2) is discussed with reference to the FIGS. 9-16 showing the first type. Building up a frame (2) using the second type is similar. To build up the frame (2), for example, a first construction unit (1) is placed against a side wall, interconnecting the floor (13) and the ceiling (14), such that the second and the third construction profile (5, 6) virtually contact the side wall and each make an angle of virtually 90° to this side wall and that the first construction profile (4) is located at a distance from the side wall. A part of the second and/or the third construction profile (5, 6) may be removed for this in advance. When the construction units (1) are delivered, they are usually in the position as shown in FIGS. 1 and 2. In order to place the construction units (1), for example first a first construction unit (1) will be brought into a position as shown in FIGS. 5 and 6. Then, the second construction profile (5) of this first construction unit (1) will be placed on the floor (13) so that the second construction profile (5) will rotate until it makes an angle of virtually 90° to the first construction profile (4) and virtually leans against the floor (13). Then the third construction profile (6) is also rotated and the snap fastener (12) is opened so that the first construction profile (4) may be lengthened. FIG. 4 shows which position the construction unit (1) may assume here. During the lengthening of the first construction profile and therefore during bringing the other said profile part (8*b*) upwards, the third construction profile (6) will contact the ceiling (14) and will rotate until the third construction profile (6) completely leans against the ceiling (14) and an angle of virtually 90° is made to the first construction profile (4) and the construction unit (1) is clamped between the floor (13) and the ceiling (14). Then, the snap fastener (12) is closed again, so that the profile parts (8*a*, 8*b*) can no longer slide relative to each other.

Then a second construction unit (1) is connected to the already placed first construction unit (1). Thus, for example, the second construction profile (5) of the second construction unit (1) will connect to the second construction profile (5) of the first construction unit (1) and this is done by clamping the clamping elements (10*a*) in the cavity (9*a*) of the first end of the second construction profile (5) of the first construction unit (1). How this is done is shown in steps in FIGS. 11-16. Each clamping element (10*a*) comprises a bent lip (11) to simplify the connection. After both second construction profiles (5) have been interconnected and they are located on the floor (13), the first construction profile (4) of the second construction unit (1) may be lengthened by opening the snap fastener (as shown in FIG. 4). As a result of this lengthening, the clamping elements (10*b*) of the third construction profile (6) of the second construction unit (1) will be provided in the first end of the third construction profile (6) of the first construction unit (1), so that the third construction profiles (6) are interconnected and the third construction profile (6) of the second construction unit (1) also virtually leans against the ceiling (14). In the same manner, also a third construction unit (1) is provided and connected to the second construction unit (1), etc., until a last construction unit (1) is located against a second side wall extending opposite the first side wall. Optionally, a part of the second and/or the third construction profile (5, 6) of the last construction unit (1) may be removed so that the frame (2) fits nicely between the said side walls.

After all construction units (1) have been placed, the frame (2) is preferably finished further with additional profiles. Eventually, then a frame (2) is obtained with one girder (3*a*) connected to the floor (13), one girder (3*b*) connected to the ceiling (14) and multiple uprights (4), wherein the first construction profiles (4) and any additional profiles form the uprights (4). To be able to connect the girders (3*a*, 3*b*) to the floor (13) and the ceiling (14), respectively, hook-and-loop fasteners may be provided, wherein then a first side of the hook-and-loop fasteners is provided against the floor (13)/the ceiling (14) and each second respective third construction profile (5, 6) comprises a second side of the hook-and-loop fasteners. With the aid of the additional profiles, a frame (2) consisting of multiple rectangular parts may simply be provided, onto which standard rectangular wall elements, such as MDF boards or plasterboards may be placed and connected for forming a wall. Thus, for example, one additional profile may be connected to each construction unit (1) located immediately next to a said side wall, so that also a profile extends next to the said side wall. In this manner, a wall element may simply be connected to the frame (2) at the height of the side wall. When the side wall shows imperfections or is not at right angles, the wall element may then be cut to shape. Prior to connecting the wall elements to the built-up frame (2), insulating material such as glass wool may be placed between the construction units (1). This may simply be done since all construction profiles (4, 5, 6) have a U-shaped cross section.

The invention claimed is:

1. A construction unit for building up a frame that has at least two girders extending opposite one another and multiple uprights interconnecting the at least two girders, the construction unit comprising:

a first construction profile, a second construction profile and a third construction profile, wherein the second construction profile and the third construction profile are each respectively connected to an end part of the first construction profile, wherein the first construction profile is provided to serve as an upright, wherein the second construction profile is provided to be part of at least a first girder in the at least two girders, wherein the third construction profile is provided to be part of at least a second girder in the at least two girders, wherein the construction unit comprises a single member having a first construction profile, a single member having a second construction profile, and a single member having a third construction profile, so that the construction unit is provided to form only one upright of the frame, that the second and the third construction profile each comprise a first and a second end extending opposite each other, wherein, in use, the first and the second ends of both the second and the third construction profiles extend at a distance from the first construction profile and are free ends, the free ends configured to enable successive interconnection of the construction unit with one or more further construction units so that a first end of the second construction profile of the construction unit is connected to a second end of the second construction profile of at least one of the one or more further construction units and that a first end of the third construction profile of the construction unit is connected to a second end of the third construction profile of the at least one of the one or more further construction units, so that the first construction profile of the construction unit extends at a distance from the at least one of the one or more further construction units, wherein the second construction profile is hingeably connected to the first construction profile between at least a first position, wherein the second construction profile virtually extends according to the first construction profile and the second position, wherein the second construction profile virtually makes an angle of 90° to the first construction profile, and wherein the first construction profile is elongated and comprises two profile parts slidable relative to each other in a longitudinal direction of the first construction profile, so that a length of the first construction profile is settable.

2. The construction unit according to claim 1, wherein the third construction profile is hingeably connected to the first construction profile between at least a first position, wherein the third construction profile virtually extends according to the first construction profile and the second position, wherein the third construction profile virtually makes an angle of 90° to the first construction profile.

3. The construction unit according to claim 1, wherein the first and the second ends of the second construction profile are built up such that the first and the second ends of second construction profiles of the one or more further construction units are engageable into one another for connection of the one or more further construction units.

4. The construction unit according to claim 3, wherein the first and the second ends of the third construction profile are built up such that the first and the second ends of third construction profiles of the one or more further construction units are engageable into one another for connection of the one or more further construction units.

5. The construction unit according to claim 3, wherein the first end of the second and/or the third construction profile comprises a cavity and the second end of the second and/or the third construction profile comprises one or more clamping elements or vice versa, wherein the one or more clamping elements are snappably receivable in the cavity.

6. The construction unit according to claim 1, wherein the construction unit operatively virtually extends according to a plane and the first construction profile has an H-shaped or a U-shaped cross section across virtually a complete length of the first construction profile, so that the first construction profile comprises two opposite U-shaped gutters or one U-shaped gutter, wherein each said gutter is accessible via an opening extending virtually perpendicularly to the plane.

7. The construction unit according to claim 1, wherein the second and/or the third construction profile has a U-shaped cross section, so that the second and/or the third construction profile comprises a U-shaped gutter, wherein at least one of the end parts of the first construction profile is provided in the gutter for connection of the first construction profile to the second and/or the third construction profile.

8. The construction unit according to claim 1, wherein the construction unit operatively virtually extends according to a plane and the first construction profile has an H-shaped or a U-shaped cross section across virtually a complete length of the first construction profile, so that the first construction profile comprises two opposite U-shaped gutters or one U-shaped gutter, wherein each said gutter is accessible via an opening extending virtually perpendicularly to the plane, and wherein a width of the U-shaped gutter is larger than a corresponding dimension of a portion of the first construction profile extending in proximity of at least one of the end parts, and that, in the first position, the portion extends in the U-shaped gutter.

9. The construction unit according to claim 1, wherein the first and the second ends of the second construction profiles of the further construction units are snappably interconnectable and/or the first and the second ends of third construction profiles of the further construction units are snappably interconnectable.

10. The construction unit according to claim 1, wherein the second construction profile is connected to the first construction profile at a height of the second end of the second construction profile and/or the third construction profile is connected to the first construction profile at a height of the second end of the third construction profile.

11. The construction unit according to claim 1, wherein, viewed in a direction of the first construction profile and in use, the first and the second ends of the second construction profile extend on both a first and a second side of the first construction profile and the first and the second ends of the second construction profile each extends at a distance of the first construction profile and/or the first and the second ends of the third construction profile extend on both a first and a second side of the first construction profile and the first and the second ends of the third construction profile each extends at a distance of the first construction profile.

12. A frame for a wall, comprising multiple construction units successively interconnected, wherein each of the multiple construction units is a construction unit according to claim 1.

13. A method of building up a frame, wherein multiple construction units are provided, wherein each of the multiple construction units is a construction unit according to claim 1, and wherein the multiple construction units are successively interconnected.

14. The construction unit according to claim 1, wherein the first construction profile is not interconnected with any of the first construction profiles of the one or more further construction units.

* * * * *